United States Patent [19]

Schneider

[11] Patent Number: 4,704,590

[45] Date of Patent: Nov. 3, 1987

[54] DEVICE FOR COUPLING MICROWAVE ENERGY

[75] Inventor: Michael D. Schneider, Los Angeles, Calif.

[73] Assignee: Hughes Aircraft Company, Los Angeles, Calif.

[21] Appl. No.: 780,530

[22] Filed: Sep. 26, 1985

[51] Int. Cl.[4] ..... H01P 5/18

[52] U.S. Cl. ..... 333/115; 333/244

[58] Field of Search ..... 333/115, 127, 243, 244, 333/245

[56] References Cited

U.S. PATENT DOCUMENTS 3,271,506 9/1966 Martin et al. ..... 333/244 X 4,539,534 9/1985 Hudspeth et al. ..... 333/115

FOREIGN PATENT DOCUMENTS 1264549 3/1968 Fed. Rep. of Germany ..... 333/115

*Primary Examiner*—Paul Gensler

*Attorney, Agent, or Firm*—J. A. Sawyer, Jr.; M. J. Meltzer; A. W. Karambelas

[57] ABSTRACT

A device for coupling or dividing electromagnetic energy, especially microwaves, between two circuits includes a pair of U-shaped conductors (36, 38) of rectangular cross-section which are coaxially disposed within corresponding slots (34, 36) in an electrically conductive base (30). The conductors have opposing, closely spaced stretches (**36*c*, 38*c*) at an intersecting juncture in the slots where electromagnetic energy is coupled from one conductor to the other. The conductors are suspended in coaxial relationship within the slots by a pair of coplanar, C-shaped elements (42) which are slidably supported within a second pair of slots (43) in the base and each have cutouts (42*a*) therein in which the conductors are closely received. A spacer (40) maintains a preselected gap between the opposing stretches of the conductors and is provided with tapered ends (40*a*, 40*b*) which cooperate with beveled surfaces (38*a*, 38*b***) on the conductors to prevent relative lateral movement between the conductors.

13 Claims, 6 Drawing Figures

Fig-1
PRIOR ART
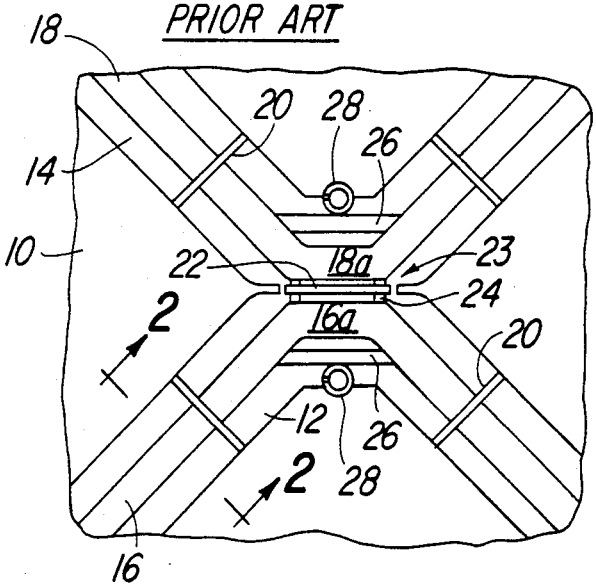
Fig-2
PRIOR ART
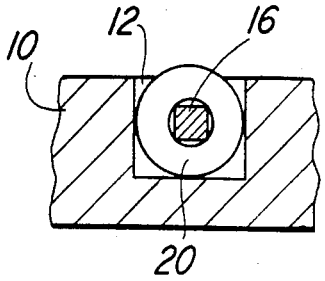
Fig-4
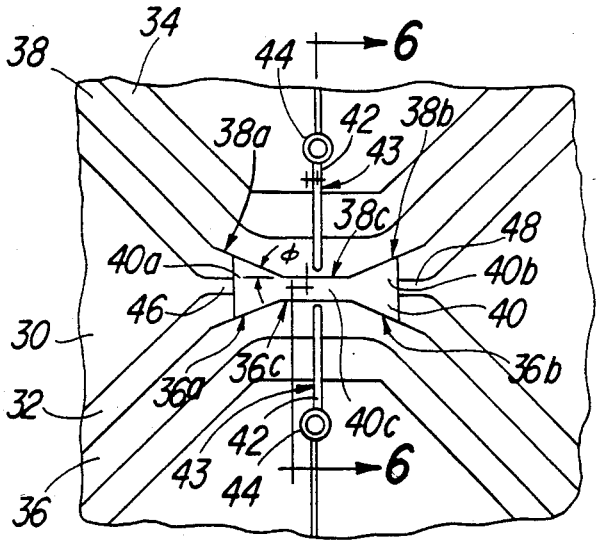
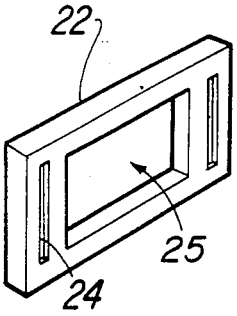
Fig-3
PRIOR ART

DEVICE FOR COUPLING MICROWAVE ENERGY

TECHNICAL FIELD

The present invention broadly relates to devices for coupling or dividing radio frequency electromagnetic energy between two circuits, especially of microwave frequency, and deals more particularly with a device of the so-called squareax type in which the coaxial conductors of the circuits are of rectangular cross-section.

BACKGROUND ART

Microwave transmitters and other communication equipment commonly employ RF power couplers, sometimes referred to as dividers, for electromagnetically coupling a portion of the energy flowing in one circuit to a second circuit. One previous type of power coupler commonly employed is depicted in FIGS. 1, 2 and 3 to which reference will now be made. The prior coupler includes an electrically conductive metal base 10 having a pair of generally U-shaped slots 12, 14 formed therein which intersect at a central juncture generally indicated at 23. A pair of conductors 16, 18 which are rectangular in cross-section (See FIG. 2) are supported within the corresponding slots 12, 14 by means of rings 20 of insulative material which are sleeved over the conductors 16, 18. The conductors 16, 18 include essentially straight bases 16a, 18a at the juncture 23 which are held in spaced apart relationship by means of a rectangular spacer 22 which is best seen in FIG. 3. The spacer 22 is formed of a high dielectric constant material and is provided with a central, rectangular cutout 25 through which electromagnetic energy is transferred. Raised lands 24 on the body of the spacer 22 control the precise spacing between the bases 16*a*, 18*a*. The bases 16*a*, 18*a* are biased toward each other and into engagement with the spacer 22 by means of bearing members 26 which are captured between the legs of the corresponding conductor 16, 18 and a tubular spring 28.

The prior art coupler described above suffers from a number of deficiencies which substantially limit the efficiency of the coupler, both in terms of its power coupling capacity and thermal efficiency, as well as the coupler's mechanical stability. The power handling capacity of the coupler is primarily limited by a phenomenon known as multipacting. Multipacting occurs under relatively high radio frequency power conditions where a very high alternating field strength is set up in a confined volume representing a tuned resonance circuit. The result of multipacting is arcing between the conductors which degrades and damages the faces of the conductors.

The supporting rings employed in the previous coupler are less than totally effective in preventing lateral movement of the conductors 16, 18 relative to each other. Such lateral movement affects the alignment between the conductors thereby degrading power coupling efficiency. Additionally, the power handling capacity of the previous coupler is severely limited since the spacer 23 employs an air dielectric between the conductors through which the electromagnetic energy is transferred.

SUMMARY OF THE INVENTION

According to the present invention, a device is provided for coupling radio frequency electromagnetic energy, particularly in the microwave range, between two circuits. The device includes an electrically conductive base having first and second, generally U-shaped slots therein which intersect at a juncture across which energy is to be transferred. A pair of generally U-shaped conductors are respectively disposed within the slots and are each defined by a bight and a pair of legs, with the bights being disposed at the slot juncture and spaced apart to define a gap across which electromagnetic energy is transferred between the conductors. A specially configured spacer is tightly sandwiched between the bights of the conductors to maintain a preselected gap between the conductors. The conductors are supported within the slots in spaced relationship to the base by means of opposed, generally C-shaped support plates which are slidably received within transverse slots in the base. Tubular springs held within apertures in the base bias the support plates toward each other and into engagement with the conductors. The base includes a pair of extensions or gates which engage the opposite ends of the spacer to prevent longitudinal movement of the spacer, and thus of the conductors relative to each other. The outer ends of the spacer include enlarged, tapered surfaces which complementally engage beveled surfaces on the conductors to form an interlock that prevents relative lateral movement between the conductors. The spacer is preferably formed of a solid dielectric material and extends completely across the gap between the bights of the conductors, thereby increasing the power handling capacity of the coupler.

These, and further features of the invention, will be made clear or will become apparent during the course of the following description of a preferred embodiment of the invention.

BRIEF DESCRIPTION OF THE DRAWINGS

FIG. 1 is a top plan view of the central portion of a typical prior art microwave power coupler;

FIG. 2 is a sectional view taken along the line 2—2 of FIG. 1;

FIG. 3 is a perspective view of the spacer employed in the prior art coupler shown in FIG. 1;

FIG. 4 is a top plan view of the central portion of the power coupler which forms the preferred embodiment of the present invention;

DESCRIPTION OF THE PREFERRED EMBODIMENT

Figure 5:
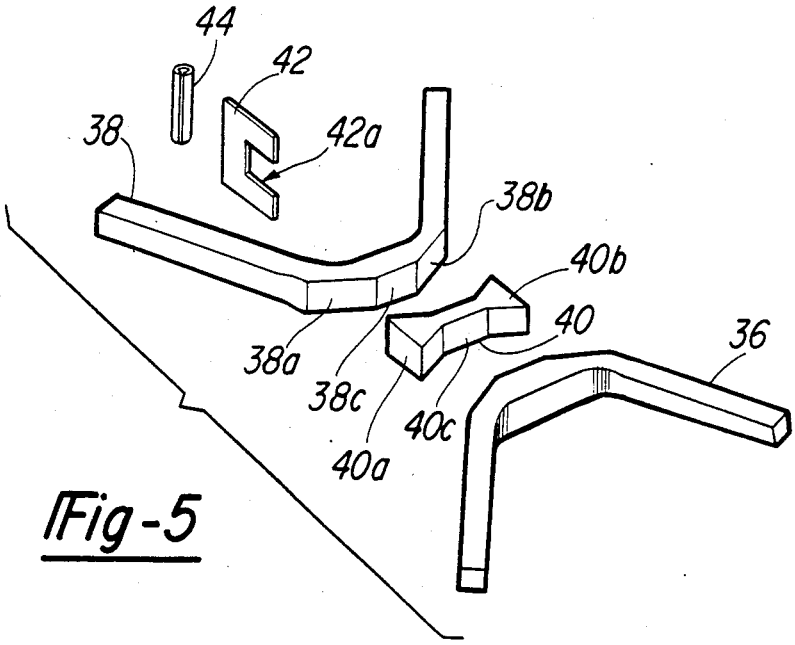
FIG. 5 is an exploded, perspective view of a single conductor and the related components of the coupler shown in FIG. 4 for holding the conductor securely on the base.
Figure 6:
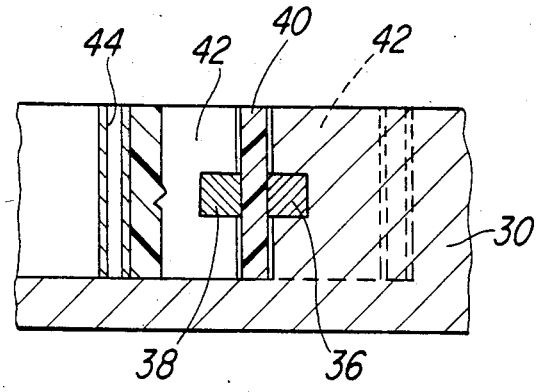
FIG. 6 is a sectional view taken along the line 6—6 in FIG. 4.

Referring to FIGS. 4–6, the present invention involves a device for coupling or dividing radio frequency (RF) energy, especially in the microwave frequency range, between two circuits. The coupler includes a base 30 formed of electrically conductive metal having a pair of generally U-shaped slots 32, 34 formed therein as by machining. The slots 32, 34 intersect at a juncture where RF electromagnetic power is transfered from one circuit to another. A pair of generally U-shaped electrical conductors 36, 38 are respectively disposed within the slots 32, 34 and are held in substantially coaxial relationship within the slots 32, 34, in spaced relationship to the base 30, by later discussed supporting elements 42.

Conductors 36, 38 form two electrical circuits between which electromagnetic energy is tranferred and there may be provided conventional mechanical coupling elements (not shown) which interconnect the conductors 36, 38 with other circuits or devices. The coupling conductors 36, 38 provide a pair of power output ports, a power input port and an isolated port.

The conductors 36, 38 are mirror images of each other in terms of their construction. Conductors 36, 38 include, at the bights thereof, respective opposing, straight stretches or surface portions 36*c*, 38*c* which extend parallel to each other and define the primary area between which the RF energy is transferred from one conductor to the other. The conductors 36, 38 are provided with a pair of outwardly tapered or beveled surface areas 38*a*, 38*b* and 36*a*, 36*b* respectively on opposite sides of the straight sections 36*c*, 38*c* for purposes which will become later apparent.

The bights of the conductors 36, 38 are held in spaced relationship to each other by means of a spacer 40 which is formed of a solid, dielectric material such as Ultem 1000 or Rexolite. The spacer 40 includes a substantially planar portion 40*c* having a thickness corresponding to that of the desired gap between the conductors 36, 38. The spacing between the surface portions 36*c*, 38*c* determines the amount of energy which is coupled from one conductor to the other. The spacer 40 includes enlarged ends 40*a*, 40*b* defined by outwardly tapered surfaces which conformly engage the corresponding beveled surfaces 36*a*, 36*b*, 38*a*, 38*b*. The tapered surfaces of the spacer 40 and that of the beveled surfaces 36*a*, 36*b* and 38*a*, 38*b* form an angle with respect to the straight sections 36*c*, 38*c* which may be, by way of example 22.5 degrees. Thus, the oppositely facing surfaces of the spacer 40 complementally engage the surfaces of the conductors 36, 38 at the juncture of the slots 32, 38 to form an interlock which prevents lateral movement of the conductors 36, 38 relative to each other along the longitudinal axis of the spacer 40.

The outer end surfaces of the spacer 40 are frictionally engaged by gates or extensions 46, 48 forming part of the base 30 which extend into the juncture of the slots 36, 38 and prevent longitudinal movement of the spacer 40. It may thus be appreciated that extensions 46, 48 further immobilize the conductors 36, 38.

The supporting elements 42 each comprise a substantially planar, generally C-shaped member formed of an electrically insulative material. One edge of each of the supporting elements 42 includes a rectangularly shaped notch or groove 42*a* therein within which the bight of the corresponding conductor 36, 38 is closely conjugally received. The supporting elements 42 thus hold or suspend the conductors 36, 38 centrally within the corresponding slots 32, 34. A portion of each of the supporting elements 42 is slidably received within transversely extending slots 43 in the base 30. A pair of split metal tubes 44 are respectively received within apertures in the base 30 at the end of the slots 43 and engage the outer end of the corresponding supporting elements 42. The tubes 44 function as springs which bias the supporting elements 42 to slide toward each other thereby forcing the bights of the conductors 36, 38 into tight sandwiched engagement with the spacer 40. The inward biasing of the supporting elements 42 also forces the tapered surfaces 36*a*, 36*b*, 38*a*, 38*b* into tight engagement with the corresponding beveled surfaces on the spacer 40. The resulting structure provides a power coupler which is considerably more rugged and mechanically stable compared to the previous types of couplers and is also capable of handling considerably higher levels of power. For example, the prior art coupler shown in FIGS. 1–3 is capable of handling approximately 10 watts whereas the preferred embodiment disclosed in FIGS. 4–6 is capable of handling approximately 100 watts of power with considerably improved thermal dissipation. The improved power handling capacity is the result of the combination of better and more closely controlled alignment between the conductors 36, 38 and the use of the dielectric material spacer 40 which interposes a layer of high dielectric constant material within the coupling area between the conductors 36, 38. Improved thermal dissipation is achieved by significantly increased surface-to-surface contact of the conductors 36, 38 with the spacer 40.

From the foregoing, it is apparent that the power coupler described above not only provides for the reliable accomplishment of the purpose of the invention but does so in a particularly effective and economical manner. It is recognized, of course, that those skilled in the art may make various modifications or additions to the preferred embodiment without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A device for coupling electromagnetic energy between first and second circuits, comprising:

an electrically conductive base having first and second slots therein, said slots intersecting at a juncture across which electromagnetic energy may be transferred;

first and second conductors respectively disposed within said slots and insulated from said base, each of said conductors being generally U-shaped and defined by a bight and pair of legs, the bights of said conductors being disposed at said juncture and spaced apart to define a gap across which said electromagnetic energy is tranferred between said conductors, each of said conductors also including a pair of spaced apart beveled surfaces respectively on opposite sides of said bights;

spacing means disposed between and abutting the bights of said conductors for maintaining a preselected spacing between said bights, the spacing means including a pair of spaced apart, enlarged ends defining outwardly tapered surfaces which tightly engage the beveled surfaces of the conductors, said beveled surfaces and said tapered surfaces cooperating with each other to pevent lateral movement of the conductors within the slots; and means for supporting each of said conductors within the corresponding slots and in spaced relationship to said base, to provide an insulating air gap between the conductors and said base, said supporting means including a pair of opposed, generally C-shaped support elements respectively associated with said first and second conductors and each having a cutout therein for closely receiving the corresponding bight of each conductor.

2. The device of claim 1, wherein said support elements comprise plates and are substantially coplanar, said plates extending transverse to the bights of said first and second conductors.

3. The device of claim 1, including means engaging an outer edge of each of said support elements for biasing said support elements toward each other, whereby to urge said bights toward each other and into tight engagement with said spacing means.

4. The device of claim 1, wherein said spacing means includes a pair of opposite end surfaces at the opposite ends of said juncture and said base includes a pair of extensions respectively extending toward said juncture and into tight engagement with the end surfaces of said spacing means whereby to prevent movement of said spacing means along an axis transverse to the longitudinal axis of said plates.

5. The device of claim 1, wherein said spacing means includes a continuous, solid member of high dielectric material disposed between the bights of said conductors.

6. The device of claim 1, wherein each of said conductors and the corresponding slots are eseentially rectangular in cross-section.

7. A device for coupling electromagnetic energy between first and second circuits, comprising:

an electrically conductive base having first and second slots therein, said slots intersecting at a juncture across which the electromagnetic energy may be transferred, the base also having a pair of extensions extending into said junction;

first and second conductors respectively disposed within said slots, each of said conductors being generally U-shaped and including a bight and pair of legs connected to the bight by a pair of angle portions, the bights of said conductors being disposed in spaced, opposing relationship within said juncture to define a gap across which said electromagnetic energy may be transferred between said conductors; and a spacer sandwiched between and tightly engaging the bights of said conductors to maintain said gap between said bights; said spacer includes a pair of end surfaces respectively at opposite ends of said junction, said spacer also including a pair of essentially straight surface portions respectively engaging the bights of said conductors and two pairs of angular sections engaging the angle portions of said conductors, to substantially prevent lateral movement of said conductors, the end surfaces also engaging the extensions of the base to prevent longitudinal movement of the spacer.

8. The device of claim 7, including a pair of generally C-shaped, planar elements for supporting said conductors within said juncture in spaced relationship to said base, said C-shaped planar elements including cutouts therein for respectively receiving the bights of said conductors therein.

9. The device of claim 8, including means engaging said C-shaped elements for biasing said bights toward each other and into tight engagement with said spacer.

10. The device of claim 7, wherein said spacer is defined by a solid piece of high dielectric constant material and includes a planar portion extending across the entire area between said bights where electromagnetic energy is transferred between said conductors.

11. A device for dividing microwave energy, comprising:

an electrically conductive base having first and second essentially rectangular slots therein, said slots intersecting at a juncture across which microwave energy may pass;

first and second electrical conductors, respectively disposed within said slots and each having an essentially rectangular cross-section, said conductors including opposing stretches at said juncture between which microwave energy may pass each of the conductors also including a beveled surface at opposite ends of the corresponding stretch;

means between said opposing stretches of said conductors for maintaining said opposing stretches in spaced relationship to each other, said means for maintaining said opposing stretches including outwardly tapered surface areas, respectively engaging the beveled surfaces of said conductors, the beveled surfaces and outwardly tapered surface areas forming an interlock to prevent movement of said conductors relative to each other along the axes of the opposing stretches; and means supporting said conductors within said slots and in spaced relationship to said base, whereby said slots and the corresponding conductors are disposed essentially coaxial, said supporting means including a pair of aligned, planar elements respectively associated with said conductors and each including an essentially rectangular cutout therein for receiving the corresponding opposing stretch of conductor therein.

12. The device of claim 11 wherein said base includes a pair of opposing, coplanar slots therein and said planar elements are respectively received within said coplanar slots.

13. The device of claim 12 including means at one end of each of said slots for biasing said planar elements toward each other and into engagement with the corresponding conductor.

* * * * *